US005254452A

United States Patent [19]

Sakuma

[11] Patent Number: 5,254,452

[45] Date of Patent: Oct. 19, 1993

[54] LIGHT-SENSITIVE SILVER HALIDE PHOTOGRAPHIC MATERIAL FOR X-RAY EXPOSURE

[75] Inventor: Haruhiko Sakuma, Hino, Japan

[73] Assignee: Konica Corporation, Tokyo, Japan

[21] Appl. No.: 774,697

[22] Filed: Oct. 9, 1991

[30] Foreign Application Priority Data

Oct. 16, 1990 [JP] Japan ..... 2-277345

[51] Int. Cl.[5] ..... G03C 1/00

[52] U.S. Cl. ..... 430/567; 430/419; 430/434; 430/517; 430/521; 430/523; 430/963; 430/966

[58] Field of Search ..... 430/523, 517, 521, 419, 430/434, 966, 567, 463

[56] References Cited

U.S. PATENT DOCUMENTS

| | | | |
|---|---|---|---|
| 3,933,502 | 1/1976 | Arai et al. | 430/521 |
| 3,948,664 | 4/1976 | Okuyama et al. | 430/966 |
| 4,514,488 | 4/1985 | Idota et al. | 430/234 |

FOREIGN PATENT DOCUMENTS

| | | |
|---|---|---|
| 299435 | 1/1989 | European Pat. Off. . |
| 330401 | 8/1989 | European Pat. Off. . |
| 1567508 | 5/1969 | France . |

OTHER PUBLICATIONS

World Patent Index, Section PQ, week 9147, class P83, AN 91-344627; JPA-3-231,738, Oct. 15, 1991.

*Primary Examiner*—Charles L. Bowers, Jr.
*Assistant Examiner*—Thorl Chea
*Attorney, Agent, or Firm*—Jordan B. Bierman

[57] ABSTRACT

A light-sensitive silver halide photographic material for x-ray exposure including a transparent support and a silver halide emulsion layer provided thereon. The photographic material exhibits a blue-light density in the unexposed portion of the developed image which does not exceed 0.09 and the red-light density is 0.02 to 0.10 and is less than the blue-light density.

5 Claims, No Drawings

LIGHT-SENSITIVE SILVER HALIDE PHOTOGRAPHIC MATERIAL FOR X-RAY EXPOSURE

FIELD OF THE INVENTION

The present invention relates to a light-sensitive silver halide photographic material suitable for use in x-ray exposure, which has improved distinguishability upon diagnostic observation of a developed image formed therefrom and imposes less strain on an observer of the image such as a medical doctor.

BACKGROUND OF THE INVENTION

Heretofore, photographic materials suitably used for direct x-ray exposure have usually been designed and manufactured by coating on a transparent support at least one light-sensitive silver halide emulsion layer and incorporating a bluish dye either in the support or in a hydrophilic colloidal layer to be provided thereon, making an image-observer easier upon diagnostic observation.

In other words, most photographic materials for radiographic use incorporate a plan for displaying a developed silver image, which originally has a yellowish color, to be seen in bluish black in color when it is placed on a display board.

Some photographic films using a non-colored or clear base support has a disadvantage that the developed silver image, which bears reddish or yellowish color, tends to give the observer a feelings of physical and mental fatigue. Thus since prior state of the art has given priority to apparent beauty rather than diagnostic distinguishability of the image. This has been done by setting density through a blue light (Db) at a high level, which has lead to degrading of distinguishability of the image, particularly in the low density region thereof. This has, to a no small extent, disturbed medical diagnosis of the image.

Thus a technique which enables a diagnostic observer to easily give his diagnosis from an image having improved distinguishability throughout the whole density range of the image, without degrading quality of the image as a picture per se, as been a long-felt demand in the art.

OBJECTS OF THE INVENTION

The primary object of the present invention is to provide a light-sensitive silver halide photographic material of which developed silver image gives bluish black image appearance, having improved diagnostic distinguisbability even in the low density portion of the image and giving the observer of the image less fatigue feeling upon observation.

The second object of the present invention is to provide a light-sensitive silver halide photographic material which has improved sharpness, distinguishability and observability of the image in the detail thereof.

The other objects of the invention self-explanatory by the following description:

SUMMARY OF THE INVENTION

The inventor has found that these objects of the present invention is accomplished by a light-sensitive silver halide photographic material for x-ray exposure comprising; a transparent support and at least one silver halide emulsion layer provided on said support, characterized in that said photographic material having been so manufactured that the density in a non light-exposed portion of a developed image through a blue-light (hereinafter referred to as "Db") is not more than 0.09, and that the density through a red-light (hereinafter referred to as "Dr") less that through the blue-light (Db) falls in a range from 0.02 to 0.10.

And, in accordance with the most advantageous embodiment of the present invention, the objects of the present invention can be achieved most effectively by a light-sensitive silver halide photographic material comprising at least one light-sensitive silver halide emulsion layer being provided on a transparent support, and said silver halide emulsion layer contains flat plate-shaped silver halide particles of which average aspect ratio being not not more than 4 and the weight percent proportion of said flat plate-shaped particles against the total number of silver halide particles contained in said silver halide emulsion layer is not less than 50% by weight.

DETAILED EXPLANATION AND THE PREFERABLE EMBODIMENTS OF THE INVENTION

In the present invention, the density through a blue light (Db) and that through a red light (Dr) in a non-exposed portion a developed image is defined, for example, densities obtained by the use of a developing solution-1 in processing steps as described below:

| [Developer Solution-1] | |
|---|---|
| Potassium Sulfite | 60.0 g |
| Hydroquinone | 25.0 g |
| 1-phenyl-3-pyrazolidone | 1.5 g |
| Boric acid | 10.0 g |
| Potassium hydroxide | 23.0 g |
| Triethylene glycol | 17.5 g |
| 5-Methyl benzotriazole | 0.04 g |
| 5-Nitro benzimidazole | 0.11 g |
| 1-Phenyl-5-mercapt-tetrazole | 0.015 g |
| glutaric acid bicarbonate | 8.0 g |
| Glacial acetic acid | 16.0 g |
| Potassium bromide | 4.0 g |
| Add water to make the total volume | 1 liter. |

[Processing Step-1]

| Process | Processing Temperature [°C.] | Processing period [sec] |
|---|---|---|
| Development | 35 | 25.5 |
| Fixing | 34 | 15.9 |
| Rinse | 33 | 12.4 |
| Drying | 45 | 25.2 |

In this connection, the above-mentioned processing step-1 corresponds to the processing temperatures and the periods of development, fixing, rinsing and drying steps, respectively, when a photographic material of the present invention is processed by the use of a Konica X-ray Automatic Processor Type SRX-501 (Manufactured by Konica Corporation).

In the present invention, the blue-light density (Db) is defined as to be density of the photographic film in a non-exposed portion, (fog density), when measured by Konica Pocket Densitometer Type PDA-65 (manufactured by Konica Corporation). through a blue filter attached to thereto. Similarly, the red-light density (Dr) is defined to be the density measured in the same manner as in the blue-light density except that a red filter in stead of the blue filter, which is attached to the above-mentioned densitometer, is used.

The light-sensitive silver halide photographic material of the present invention has, in its non-exposed portion and in terms of chromaticity coordinates, X and Y values of X=0.300 to 0.320 and Y=0.310 to 0.336, respectively. X and Y values of the photographic material may be obtained, for example, by using a spectro photometer such as Hitachi spectro photometer Type U-3210 (manufactured by Hitachi Manufacturing Company Ltd.).

Thus, by designing a light-sensitive silver halide photographic material so that Db and Dr in the non-exposed portion thereof fall in the rage defined in the present invention, improved distinguishability with the density portion, and is less liable to give can be achieved. In this connection, X and Y values of the conventional photographic materials currently available in the market have $X<0.295$ and $Y<0.305$, respectively, in the case of those using a blue base support, and $X>0.325$ and $Y>0.340$, respectively, in the case a clear transparent base is used.

In the present invention, in order for a photographic material to bear a color as defined herein-above, either a support or any one or more layers which constitute the photographic material may be dyed. Or both support and the layer may be dyed. For dyeing the photographic material in the invention, any suitable dye or dyes may be used. The dyes which may suitably used in the present invention are described below:

The dyes which can suitably be used in the present invention are those hydrophobic ones.

For example, any one or more dyes may optionally be selected

[EXEMPLIFIED COMPOUND]

A-1

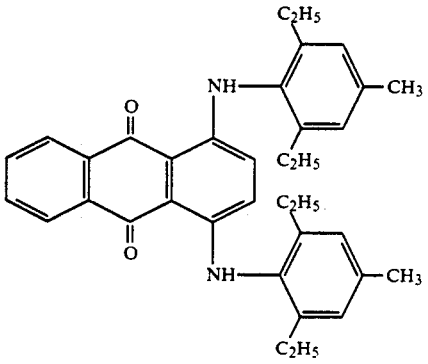

A-2

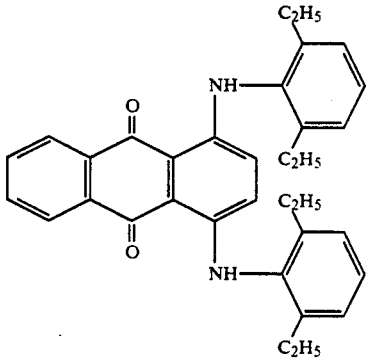

A-3

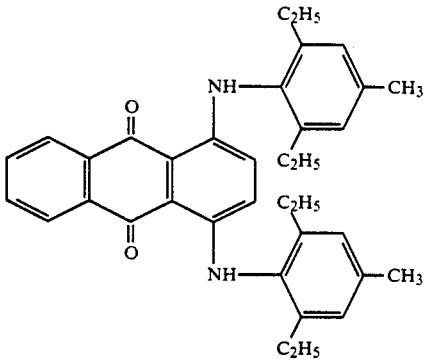

A-4

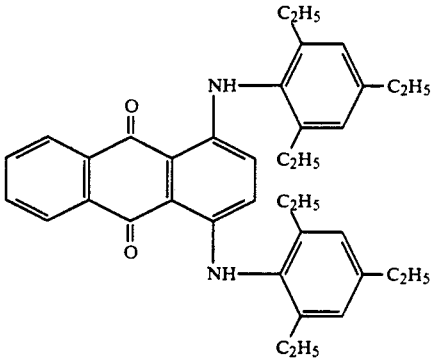

A-5

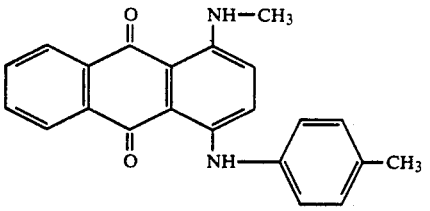

A-6

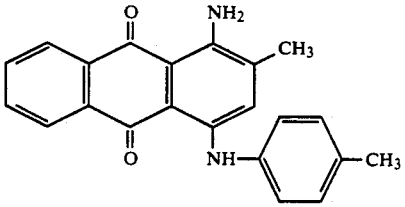

A-7

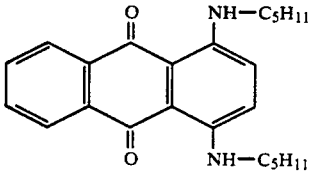

A-8

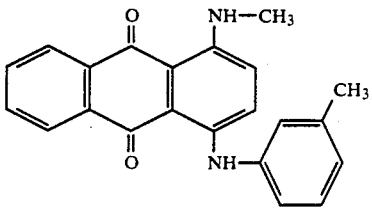

-continued
[EXEMPLIFIED COMPOUND]
A-9
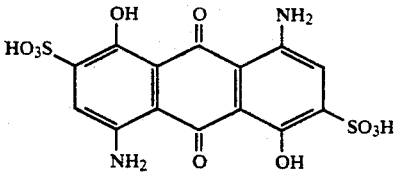
A-10
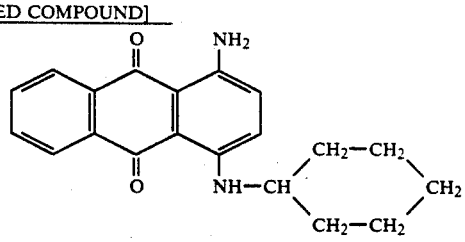
A-11
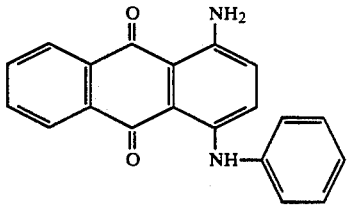
C-1
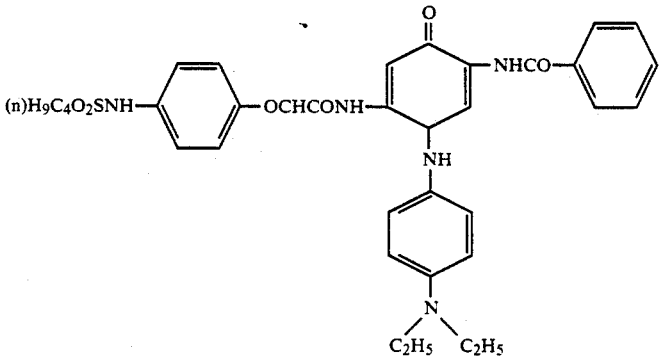
C-2
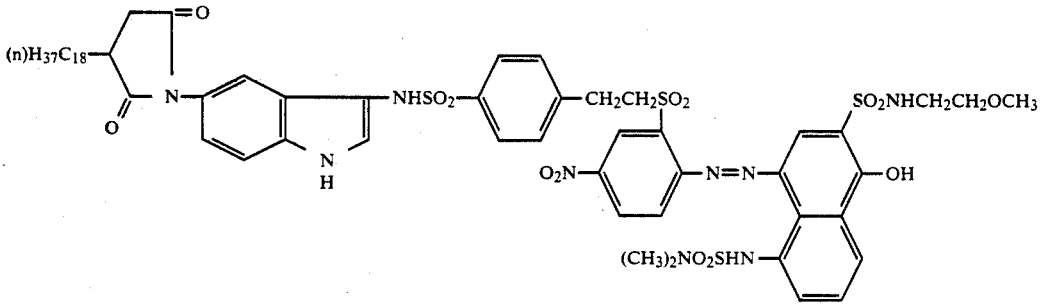
C-3
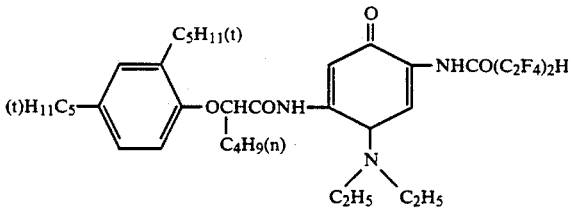
C-4
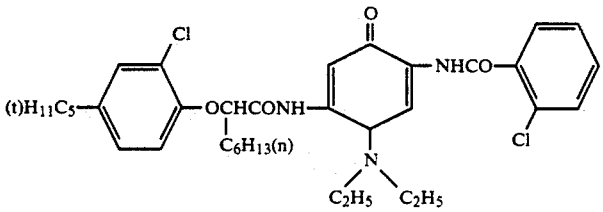
For example, any one or more dyes may optionally be selected from, for example, anthraquinone-type dyes, azo-type dyes, azomethine dyes, indoaniline-type dyes, oxonol-type dyes, triphenylmethane-type dyes, carboxy amine dyes or styryl dyes. Examples of dyes which can preferably be used in the present invention are given below. However, of course, the scope of the present invention is not limited by these examples.

These exemplified compounds may be either manufactured in the manner disclosed in, for example, Japanese Patent Pre-examined Publication Nos. (Tokkai) Sho 61-48854(1986); Sho 61-7838(1986); Sho 60-243654(1985); Sho 60-32851(1985); Sho 57-26849(1982); "Senryou Kagaku (Dye Chemistry)" written by Yutaka Hosoda; or "Color Index" published by The Society of Dyers and Colorists, American Association of Chemist and Colorists, or obtained from the manufacturers listed therein.

These exemplified compounds are dyes having their absorption maxima within a rage from 570 to 700 micrometers.

In order to incorporate the dye into a photographic silver halide emulsion, any conventionally known method may be applied:

For example, the dye may be incorporated into the photographic emulsion in a similar manner as incorporation of a dye-forming coupler into a photographic emulsion; i.e., after dissolving the dye in a substantially hydrophobic high boiling point organic solvent, together with, if necessary, a low boiling point organic solvent, mixing the solution in an aqueous gelatin solution containing a surface active agent and then subjecting thus prepared solution to emulsion dispersion by the use of a dispersion device such as a colloid mill, a homogenizer or an ultrasonic dispersion device and then incorporating thus prepared emulsion into a light-sensitive silver halide photographic layer.

As examples for high boiling point organic solvent, carbonic acid esters, phosphoric acid esters, carbonic amides, ethers and substituted hydrocarbons may be mentioned. More specifically, for example, a di-n-butyl phthalate, a di-isooctylphthalate, a di-methoxyethylphthalate, a di-n-butyl adipic acid ester, a di-n-butyl azelate, a di-iso-octyl azelate, a tri-n-butyl citrate, a butyl laurate, di-n-sebacate, a tricresyl phosphate, a tri-n-butyl phosphate, a tri-iso-octyl phosphate, a N,N'-diethylcaprylic acid amide, a N,N'-di-methyl palmitic acid amide, a n-butyl-pentadecylphenyl ether, an ethyl-2,4-tert-butylphenyl, an succinate, a maleate, a paraffin chloride may be mentioned. These high boiling point organic solvent may be used either singly or in combination of two or more.

As for low boiling point organic solvent, for example, an ethyl acetate, a butyl acetate, a cyclohexane, a propylene carbonate, a methanol, a sec- butyl alcohol, a tetrahydrofurane, a di-methyl formamide, benzene, a chloroform, acetone, a methylethyl ketone, a diethylsulfoxide, a methylcelsolve may be used singly or in combination of two or more kinds.

Further, as for surface active agent, any one or more of anionic surfactants, cationic surfactants or nonionic surfactants may optionally be used. For example, an alkylbenzene sulfonate, a sulfosuccinate, a saponin may be mentioned. As for a binding agent, a gelatin may usually be used and, As for gelatin, for example, either an alkali-treated gelatin, an acid-treated gelatin, a modified gelatin such as those disclosed in Japanese Examined-Patent Publications (Tokko) Nos. Sho 38-4854(1963), Sho 40-12237(1965), U.S. Pat. No. 2,525,753 may be used either singly or in combination of two or more kinds. Further, whenever necessary or adequate, other natural or artificially synthesized binder, such as a polyvinyl alcohol or a polyvinyl pyrrolidone may optionally be used.

It may also be possible that those dyes, which may be used in the present invention, are emulsion-dispersed in the state of a solution in a low boiling point organic solvent and added to a photographic emulsion layer.

Furthermore, in the above-mentioned emulsion-dispersion process, the dye may be used either singly or, if necessary, together with other photographically useful additives such as an oxidation inhibitor, anti-staining agent or a fluorescent whitening agent.

In the present invention, by the use of the abovementioned dyes with or without other optional compound, if necessary, a photographic material having desired Db and Dr can be obtained.

For example, in a case where a non-colored polyethylene terephthalate support of 175 micrometer thickness is used, more than 10 mg per square meter of above-mentioned dye may necessarily be used in order to satisfy the predetermined condition of the present invention.

According to a preferable embodiment of the present invention, suitable amount of the dye to be used is within a range of from 10 to 250 mg per a unit square meter of the photographic material to be manufactured. When the amount added is less than 10 mg, coloring effects may not be obtained. When, on the other hand, an excess amount not less than 250 mg is used, color density becomes too high, which results in decrease in distinguishability of the image.

According to another preferable embodiment of the invention, the photographic material may be dyed by incorporating one or more dyes mentioned hereinabove into one or more layers which are provided on the support and constitute photographic layers. For example, a silver halide emulsion layer, a protective layer, an undercoat layer or a subbing layer, an antihalation layer or a backing layer may be mentioned as a layer constituting the photographic material of the invention.

In the case where a support is colored, an optionally selected dye or dyes may be incorporated by dissolution into a coating liquid which is to form the support so that said support gives a predetermined density.

When, on the other hand, the layer constituting the photographic material is colored, such a dye or dyes may be added to a coating solution are used in the form of a solution containing the dye dissolved by an organic solvent or, alternatively, in the form of powder by crushing a solid dye by the use of, for example, a mill such as a ball mill to fine powder with an approximate diameter of from 0.01 to 1.0 microns.

According to one of the most preferable embodiments of the present invention, at least one anthraquinone-type dye selected from Exemplified Dyes from A-1 to A-11 can be used when the support is colored.

In the case where a photographic constituting layer is dyed, those Exemplified Dyes mentioned above and Exemplified Dyes C-1 to C-4 may preferably be used.

As a material suitably used for the transparent support in the present invention, a polyester such as polyethylene terephthalate, a cellulose acetate, a cellulose nitrate and a polyvinyl acetal may suitably be used.

In photographic materials for practical use, there is usually provided a subbing treatment between the support and the photographic constituting layer. As a material used for the subbing treatment, a copolymer of a vinyl chloride or a vinylidene chloride, a copolymer of an esters of vinyl alcohols, copolymers containing an unsaturated carboxylic acid, copolymers of dienes such as a butadiene, copolymers of an acetal, copolymers containing an unsaturated carboxylic acid anhydride such as maleic acid anhydride can be mentioned particularly, vinylalcohol esters such as vinyl acetate or copolymers of vinyl alcohol with a styrene or their open ring products by water, alkali, alcohols or amines; cellulose derivatives such as nitrocellulose and diacetyl cellulose; compounds containing an epoxy group; gelatin or its derivatives and copolymers of polyorefin may be mentioned.

The silver halide emulsion which is suitably used in the photographic material of the present invention contains flat plate-shaped silver halide particles of which average particle diameter/thickness ratio (hereinafter referred to as "aspect ratio"), which is herein referred to as "average aspect ratio", is not less than 4, and more preferably, between 4.0 and 20.

According to the most preferable embodiment of the invention, the average thickness is not less than 0.3 microns, preferably, between 0.3 and 0.5 microns and most preferably, the thickness is 0.3 microns.

In the present invention, "diameter" of the silver halide particle is defined as a diameter of a circle having an equivalent projection area of a silver halide particle when it is measured by an electron microscopic picture image of the particle. Also, in the present invention the thickness of the silver halide particle is defined as the minimum distance between any two parallel surfaces contained in the flat plate-shaped silver halide particle. The thickness of this flat plate-shaped silver halide particle is obtained from an electron microscopic sectional picture image of the silver halide particles contained in the silver halide emulsion layer, which is prepared by coating and drying silver halide emulsion provided on the support.

In order to obtain the "average aspect ratio" of the silver halide particles, diameters and thickness of at least 100 particles should preferably be measured.

In the present invention, proportion of the flat plate-shaped silver halide particles against the total number of silver halide particles contained in silver halide emulsion layer, is preferably not less than 50% by weight, more preferably not less than 60%, and most preferably, not less than 70% by weight.

The silver halide emulsion containing the flat plate-shaped silver halide particles, which can advantageously be used in the present invention is preferably, of a monodispersion type. Preferably, a silver halide emulsion in which not less than 50% by weight of the total silver halide particles have their particle sizes falling within plus minus 20% around the average particle size thereof may be used.

The silver halide emulsion containing the flat plate-shaped silver halide particles advantageously used in the present invention, may optionally be selected from silver chloride, silver bromide, silver iodide, silver chlorobromide, silver iodo bromide, silver chloro-iodo bromide. In view of its high sensitivity, a silver iodobromide containing from 0.1 to 4.0 mol % and, more preferably, from 0.5 to 3.0 mol % of silver iodide is particularly advantageous. As for silver halide composition within a flat plate-shaped silver halide particle, it may be any form in which either the whole particle is composed of a uniform and single silver halide composition, or a particle in which, for example, a silver iodide is made existed locally in the silver bromide particle.

According to one of the most preferable embodiments of the present invention, a silver halide emulsion containing silver iodobromide particles in which silver iodide is locally made existed at a high proportion in the center of the particles, may advantageously be used.

As to the manners for manufacturing the silver halide emulsion containing the flat plate-shaped silver halide particles, used advantageously in the present invention, disclosures, for example, in Japanese Patent Pre-examination Publication (Tokkai) Nos. Sho 58-113927(1983), Sho 58-113928(1983), Sho 58-113934(1983), Sho 62-1855(1987); European Patents Nos. 219,849, 219,6850 may be referred to as giving useful information.

As for the manner for manufacturing a silver halide emulsion containing mono-dispersion flat plate-shaped particles, for example, Japanese Patent Pre-examination Publication (Tokkai) Sho 61-6643(1986), etc. may be referred.

A silver iodobromide emulsion containing flat plate-shaped particles having high aspect ratio may be manufactured, for example, in the following manner:

Into an aqueous gelatin solution of which pBr is maintained at not larger than 2.0, either a silver nitrate solution or a mixture of silver nitrate solution and a halide solution are added simultaneously, to produce seeds crystals, and thereafter these seed crystals are grown up by means of a double-jet mixing process.

Particle size of the flat plate-shaped silver halide particles may be adjusted by controlling speed of addition of either silver solution or halide solution.

Also, the average silveriodide content in the flat plate shaped silver halide emulsion may be adjusted by changing halide composition in the halide solution, or changing iodide/bromide ratio in the halide solution.

Further, depending upon necessity a silver halide solvent such as ammonia, a thioether, a thiourea, etc. may be used during manufacture of the silver halide emulsion.

After completing addition of the silver solution and the halide solution to form a silver halide emulsion which contains flat plate-shaped silver halide particles, washing or rinsing process may be employed for the purpose of removing unnecessary water soluble halides from the emulsion. As preferable washing step such as a noodle-rinsing process or a sedimental flocculation separation process may be applied. As preferable examples for removing the water soluble halides, for example, a method using an aromatic hydrocarbon-type aldehyde resin as disclosed in Japanese Patent Post-examination Publication (Tokko) Sho 35-16086(1960) and a method using a high molecular weight flocculants,particularly those compounds Exemplified Compound G3 and G4 as disclosed in Japanese Patent Pre-examination Publication (Tokkai) Sho 63-158644(1988) may be mentioned as being advantageous desalting methods.

The silver halide photographic emulsion used in the present invention may be subjected to a conventionally known physical and chemical ripening processes, in which various other photographically useful additives or ingredients may optionally be used.

As typical photographic additives, for example, those disclosed in The Research Disclosure Nos. 17643 (published in December 1978) and 18716 (Published in November 1979) may be mentioned.

The typical photographic additives and the places in which they appear in these references are classified and listed below:

| Class of Additives Place Appearing in the Research Disclosure | No. 17643 Page | Class | No. 18716 Page | Column |
|---|---|---|---|---|
| Chemical Sensitizer | 23 | III | 648 | upper-right |
| Sensitizing Dyes | 23 | III | 648 | right-649 left |
| Development Accelerator | 29 | VI | 648 | upper-right |
| Anti-foggant | 24 | VI | 649 | down-right |
| Stabilizer | 24 | VI | 649 | |
| Anti-contaminant | 25 | VII | 649 | right-650 left |
| Image Stabilizer | 25 | VII | | |
| UV Absorber | 25-26 | VIII | 649 | right-650 left |
| Filtering Dye | 25-26 | VIII | 649 | right-650 left |
| Whitening Agent | 24 | V | | |
| Hardening Agent | 26 | X | 651 | left |
| Coating Aid | 26-27 | XI | 650 | right |
| Surfactant | 26-27 | XI | 650 | right |
| Plasticizer | 26-27 | XII | 650 | right |
| Lubricant | 27 | XII | 650 | right |
| Anti-static Agent | 27 | XII | 650 | right |
| Matting Agent | 28 | XIV | 650 | right |
| Binder | 26 | IX | 651 | left |

As a support suitably applicable to the photographic material of the invention, for example, those disclosed in the above-mentioned RD-17643, on page 28 and in the right column on page 29, in the left column on page 647 of RD-18716 may be mentioned.

The surface of these plastic supports may usually be provided with, for the purpose of enhancing adhesive power, a subbing layer, or they may be subjected to, for example, x-ray irradiation or corona discharge.

Then the silver halide emulsion may be provided on either side or both sides of the support.

The present invention is applicable to various types of light-sensitive silver halide photographic materials, however, the present invention is most advantageously applicable to a highly photo-sensitive, black-and-white type photographic material.

In the case when the present invention is adapted to photographic materials used for medical radiographic use, it is usually desirable for the photographic material of the invention is exposed to a penetrating electromagmetic radiation such as x-ray, by the use of a pair of so-called sensitizing screens, which comprises, as its main component, a fluorescent material and is able to emit near ultraviolet or visible rays, in contact with both surfaces of the photographic material.

EXAMPLES

The present invention is here-in-below further explained in concrete with reference to examples. However, these examples do by no means limit the scope of the present invention.

EXAMPLE 1

(1) Preparation of Mono-dispersion Silver Halide Emulsion iodobromide particles containing therein 2.0 mol % of silver iodide and having an average particle diameter of 0.2 micrometers contained in a silver iodebromide emulsion as seed nuclei, were grown up, under conditions of pH at 9.8 and pAG AT 7.7, to monodisperse silver iode bromide particles containing therein 30 mo % of silver iodide.

Then, three kinds of monodisperse silver iodobromide emulsions containing average silver iodide content of 2.2 mol % and average particle diameters of 0.375 micrometers (hereinafter referred to as "EM I-1"), 0.64 microns (herein-after referred to as "EMI-2") and 1.210 microns (herein-after referred to as "EM I-3"), respectively, were prepared by adding equivalent molar amount of silver nitrate solution and a potassium bromide solution under conditions of pH at 8.2 and pAg at 7.8. These three kinds of monodisperse emulsions were then, subjected to desaltationdeescalation process according to a conventional manner, i.e., while temperature of respective emulsions at 40° C., a formalin condensation product of a sodium naphthalene sulphonate and magnesium sulfate were added, to cause coagulation.

The variances of thus obtained emulsions expressed in terms of $S/\bar{r}$. wherein S stands for standard deviation and $\bar{r}$ stands for average particle size, were respectively less than 0.16. This means that these exemplified emulsions show excellent mono dispersibility.

(2) Preparation of Flat Plate-shaped Particles while agitating a 5.5 liters of 1.5% gelatin solution under conditions of temperature at 80° C. and pH at 5.7, a 2.1 equivalent mols of potassium bromide solution and 2.0 equivalent mol of silver nitrate solution were added by means of a conventional double-jet method for a period of 2 minutes. During the addition of the solutions pBr of the mixture solution was maintained at 0.8, which means the consumption by 0.53% of the total silver nitrate used. Then after addition of the pottasium bromide solution was stopped the silver nitrate solution was added for a period of 4.6 minutes. This means that 8.6% of the total silver nitrate was consumed.

Then, the potassium bromide solution and the silver nitrate solution were simultaneously added for a period of 13 minutes, while pBr of the solution was maintained at 1.2 and the quantity of the addition was accelerated so that the flow rate of the addition was 2.5 times greater at the time of completion of addition than that at the commencement of the same, when 43.6% of the total silver nitrate was consumed.

After stopping adding the potassium bromide solution, the silver nitrate solution was added again for a period of one minute, when 4.7% of the total silver nitrate used was consumed.

Then, 2.0 mol potassium bromide solution containing 0.55 mols of potassium iodide was added together with the silver nitrate solution for a period of 13.3 minutes, where quantity of addition was accelerated so that the flow rate of the addition becomes 1.5 times greater at the time of completion of addition than that at the time of commencement thereof, when 35.5% of the total silver nitrate was consumed.

Then 1.5 g per 1 mol of silver of sodium thiocyanate was added to thus prepared emulsion and maintained for 25 minutes. Then 0.60 mols of iodide solution and the silver nitrate solution were added at the same flow rate by means of a conventional double-jet method for an approximate period of 5 minutes, until the time when pBr Br of the emulsion became 3.0, when about 6.6% of the total silver nitrate used was consumed. The total amount of the silver nitrate consumed was approximately 11 mols.

Thus a silver halide emulsion, herein-after referred to as "EM-II", containing therein flat plate-shaped silver halide particles having an average particle diameter of 1.62 microns and the aspect ratio of about 16 was prepared. The silver halide particles of the prepared emulsion comprised flat plate-shaped particles at the proportion of not less than 80% in terms of projected areal proportion against the total projection area thereof.

Preparation of Sample Photographic Material, Process and Evaluation

Into each of the thus prepared emulsions "EMI-1" through "EMI-3" and "EM-II", purified water was added to make the volume of the emulsion to be 500 ml per 1 mol of silver. Then after adjusting the temperature of each emulsion at 55° C., Optical Sensitizing Dyes A and B were added to the respective emulsions so that Scotia amount of Addition of the Dye A against Dye B becomes 200:1. The total amount of the optical sensitizing dyes added to the respective sample emulsions in terms of mg per 1 mol of silver were as follows:

| Emulsion | Amount of Dyes Added (mg/mol Ag) |
|---|---|
| EM I-1 | 820 |
| EM I-2 | 600 |
| EM I-3 | 360 |
| EM I-4 | 500 |
| EM II | 600 |

Ten minutes After the addition of the optical sensitizing dyes, the following amounts of ammonium salt thiocyanate was added to the respective emulsions:

| Emulsion | Amount of Addition of Ammonium Salt of Thiocyanate (mols/mol Ag) |
|---|---|
| EM I-1 | $4 \times 10^{-3}$ |
| EM 1-2 | $2 \times 10^{-3}$ |
| EM 1-3 | $3 \times 10^{-3}$ |
| EM II | $3 \times 10^{-3}$ |

Then after adding adequate amounts of acidic auric chloride and sodium thiosulphate to th respectictive emulsions, emulsions were subjected to chemical ripening under conditions of pH at 6.15 and silver potential (EAg) at 50 mv.

15 minutes before the completion of the chemical ripening, i.e., 70 minutes after the commencement of the chemical ripening, 200 mg of potassium iodide per 1 mol of silner was added to the respective emulsions.

Further, 5 minuts after the addition of these additives, 10% (wt/vol) of acetic acid was added to the respective emulsions in order to lower the pH of the emulsions at 5.6. After maintaining the pH value of the respective emulsions at this point for 5 minutes, 0.5% (wt/vol) of potassium hydride was added to the respective emulsions, restoring the pH value of the emulsions at 6.15. Thereafter, 4-hydroxy-6-methyl- 1,3,3a,7-7-tetraza indene was added to the emulsions, to complete the chemical ripening.

After mixing these emulsions as shown Table A, aftermentioned emulsion additives were added to th respective emulsions, to prepare silver halide emulsions for coating.

For reference, sodium carbonate and potassium bromide solution were used for the purpose of adjusting pH and the silver potential of the emusions for cating to be 6.51 and 68 mv (at 35° C.), respectively.

TABLE A

| Sample No. | Mixing Ratio of Emulsion | | | |
|---|---|---|---|---|
| | EM I-1 | EM I-2 | EM I-3 | EM II |
| 1 through 6 | 30 | 40 | 30 | — |
| 7 through 11 | 24 | 56 | 20 | — |
| 18 through 22 and 28 through 30 | | | | |
| 12 through 17 and | — | — | 21 | 79 |

TABLE A-continued

| Sample No. | Mixing Ratio of Emulsion | | | |
|---|---|---|---|---|
| | EM I-1 | EM I-2 | EM I-3 | EM II |
| 23 through 27 | | | | |

Using thus prepared coating solutions, samples were prepared in the following manner: i.e., both sides of a support were coated simultaneously at the coating speed at 80 meters per a minute by the use of two slide hopper-type coating machines so that the coated amount with respect to gelatin of both a high-sensitive emulsion layer and a low-sensitive emulsion layer to becomes 2.0 mg/m, and that the coated amount of silver halide particles in terms of the amount of silver to be those shown in Table-1. Further, a coating solution for a protective layer was prepared by by thuse of hereinafter mentioned additives and coated in the same manner as in the case of the silver halide emulsion layer, on the silver halide emulsion layer at an amount, with respect to gelatin, of 1.15 g/m.

As the material for the support, a transparent polyethyrene terephthalate film of 175 microns thick, which is subbed with a 10 wt % aqueous dispersion-containing copolymer solution, of which copolymer consists of 50 wt % of glycidyl methacrylate, 10 wt % of methyl methacrylate and 40 wt % of butylmethacrylate, was used.

For the purpose of coloring, a dye-dispersion solution prepared by a method, which is herein-aftern explained, was added to the silver halide emulsion layer as shown in Table-1.

The optical sensitizing dyes used for preparing the samples are as follows:

Optical Sensitizing Dye A

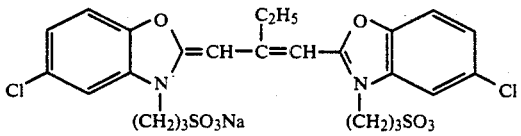

Optical Sensitizing Dye B

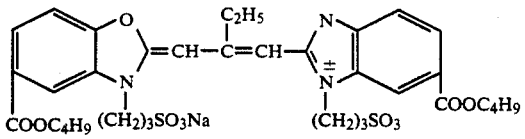

Other additives used for the preparation of a coating solution of the light-sensitive silver halide emulsion and the amount used in terms of weight per 1 mol of silver halide are as follows:

| | |
|---|---|
| 1,1-Di-methylol-1-bromo-1-nitro methane | 70 mg |
| | 150 mg |

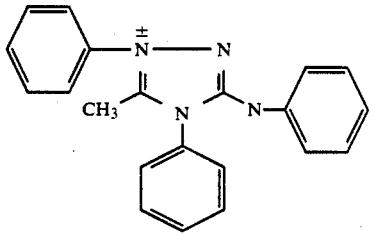

-continued

| | |
|---|---|
| t-Butyl catecohl | 400 mg |
| Polyvinyl pyrroridone (molecular weight: 10,000) | 1.0 g |
| Styrene-maleicacid anhydride copolymer | 2.5 g |
| Nitrophenyl-triphenylphosphonium chloride | 50 mg |
| 1,3-di-hydroxy benzene-4-sulfonic acid ammonium | 4 g |
| 2-mercaptobenzimidazole-5-sodium sulfate | 1.5 mg |
| 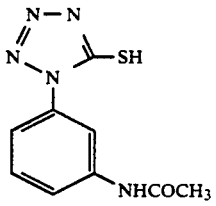 | 15 mg |
| 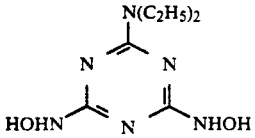 | 50 mg |
| 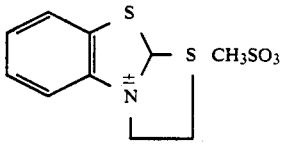 | 70 mg |
| 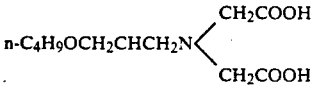 | 1 g |

Further additives used for a coating solution for the protective layer are asfollws, in which the amount of addition of the additive is expressed in terms of weight per 1 liter of the coating solution.

| | |
|---|---|
| Lime-treated inert gelatin | 68 g |
| Acid-treated gelatin | 2 g |
| Coating aid 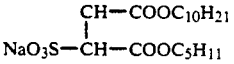 | 0.3 g |
| polymethyl methacrylate (matting agent having 3.5 microns of surface average particle size) | 1.1 g |
| silicon dioxide particles (matting agent having an average particle diameter of 1.2 microns | 0.5 g |
| Colloidal silica (Ludox AM; produced by duPond Co.) | 35 g |
| 2% aqueous solution of 2,4-di-chloro-6-hydroxy-1,3,5-triazine as a gelatin hardener | 12 ml |
| 40% aqueous solution of glyoxale as gelatin hardener | 2.0 ml |
| 35% fomalin as a gelatin hardener | 2.0 ml |
| 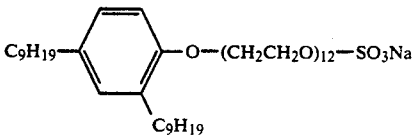 | 1.0 g |
| 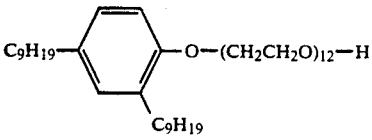 | 0.4 g |

-continued

| | |
|---|---|
| 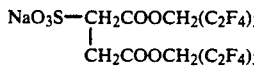 | 0.5 g |
| 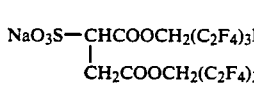 | 2.0 g |

Dye dispersed emulsion was prepared in the following manner:

Among the Examplified dyes, 10 kg of those dyes shown in Table 1 were taken for weighing. Then respective dyes were dissolved by a mixed solvent consisting of 12 liters of tricresyl phosphate and 12 liters of ethyl acetate at the temperature of 5° C. This solution is hereinafter referred to as "a solvent solution". On the other hand 270 ml of 9.3% aqueous gelatin solution, in which 1.35 kg of an anionic surface active agent (herein referred to as "AS", having a chemical structure is shown below, was dissolved at 45° C.

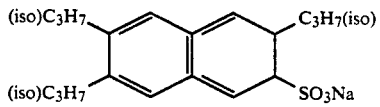

(AS)

This solution is hereinafter referred to as "an aqueous solution".

Dispersion of the above-mentioned solvent solution and the aqueous solution was carried out for a consecutive period of 20 minutes, first by putting these solutions into a dispersion pot and, then, by gradually decreasing the atomospheric pressure in th pot, while maintaining the temperature of the solutions at 40° C. and adjusting rotational frequency of a high speed rotary propeller installed in the dispersion pot.

Into a dispersion product an additives, of which chemical structures are given below and water were added to make the total volume of the dispersion product be 240 ml, which is thereafter cooled down and solidified.

| | |
|---|---|
| 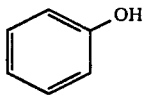 2.5% aqueous solution | 16 liters |
| 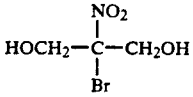 | 8 g |

The arealaverage paticle size of the solid gredient of the obtained dispersion product fell within a range between 0.08 and 0.10 microns.

Thus obtained Sample photographic materials were subjected sensitometry by being exposed to x-ray for a period of 0.05 seconds by using a x-ray tube under conditions of tube electric potential at 90 kVp and tube electric current at 20 mA; processed by the use of Konica Automatic Processor Type SRX-501 (wherein as a developer solution, the above-mentioned Developer Solution and as a fixing solution XF-SR, (manufactured by Konica Corporation) are used, to obtain sensitometric characteristic curve and image sharpness of the respective samples.

In order to obtain the sharpness of the image of the sample, a Hunk Test Chart SMS 5853 (produced by Konica Medical Co., Ltd.) was used and the sample was processed in the same manner as in the sensitmetric measurement thereof.

Further, the amount of exposure given to the respective samples was determined so that the average density of th developed silver image formed by the use of the Hunk Test Chart mat become 0.20±0.02.

Evaluation of Sharpness

Sharpness was evaluated and classified by observing the degree of distinguishability of the image formed on the respective samples using a magnifying glass as shown below: thus, A represents that the sharpness is most excellent and E, the poorest.

A: Distinguishable up to 10 LP/mm.
B: Distinguishable up to 8 LP/mm.
C: Distinguishable up to 6 LP/mm.
D: Distinguishable up to 5 LP/mm.
E: Distinguishable up to 4 LP/mm

Evaluation of Fatigue Feeling Effect on the Observer

After ten x-ray images of a breast phantom were obtained under the same exposuring and processing conditions as those of the sharpness evaluation, the formed images were consecutively observed for 15 seconds per a single picture, to evaluate fatigue feeling given to the obsever.

Based on the judging standard given below, ten pictures of randomly extracted sample images were observed by five observer. The fatigue feeling effect on the obsever was evaluated by obtaining the average remarks by five observers, by rounding off to one decimmal place.

The following is the classified fatigue effects evaluated by fatigue feelings of the observer:

1: Feel almost no fatigue.
2: Feel a little fatigue
3: Feel a fatigue
4: Feel a considerable fatigue.
5 Feel a cosiderable fatigue and, moreover, image was seen dirty.

The results are given in Table 1.

TABLE 1

| Sample No. | Dye Added Class | Dye Added Amount | Transmission Density $D_R$ | Transmission Density $D_B$ | Transmission Density $D_R$-$D_B$ | Sharpness | Degree of Fatigue |
|---|---|---|---|---|---|---|---|
| 1 | None | — | 0.04 | 0.05 | 0.01 | B | 4 |
| 2 | A-1 | 4.0 | 0.05 | 0.05 | 0 | B | 4 |
| 3 | A-1 | 7.5 | 0.07 | 0.05 | 0.02 | B | 2 |
| 4 | A-1 | 15 | 0.09 | 0.05 | 0.04 | B | 2 |
| 5 | A-1 | 30 | 0.12 | 0.05 | 0.07 | C | 1 |
| 6 | A-1 | 45 | 0.16 | 0.05 | 0.11 | E | 1 |
| 7 | A-2 | 4.5 | 0.05 | 0.05 | 0 | A | 4 |
| 8 | A-2 | 9.0 | 0.07 | 0.05 | 0.02 | A | 2 |
| 9 | A-2 | 18 | 0.10 | 0.05 | 0.05 | A | 2 |
| 10 | A-2 | 36 | 0.15 | 0.05 | 0.10 | B | 1 |
| 11 | A-2 | 72 | 0.25 | 0.06 | 0.19 | D | 1 |
| 12 | A-1 | 4.0 | 0.05 | 0.05 | 0 | A | 5 |
| 13 | A-1 | 7.5 | 0.07 | 0.05 | 0.02 | A | 2 |
| 14 | A-1 | 15 | 0.09 | 0.05 | 0.04 | A | 2 |
| 15 | A-1 | 30 | 0.12 | 0.05 | 0.07 | B | 1 |
| 16 | A-1 | 45 | 0.16 | 0.05 | 0.11 | D | 1 |
| 17 | C-1 | 0 | 0.04 | 0.05 | −0.01 | A | 5 |
| 18 | C-4 | 5.0 | 0.05 | 0.05 | 0.01 | A | 4 |
| 19 | C-4 | 10.0 | 0.07 | 0.05 | 0.02 | A | 2 |
| 20 | C-4 | 20.0 | 0.09 | 0.05 | 0.04 | A | 1 |
| 21 | C-4 | 40.0 | 0.13 | 0.06 | 0.07 | B | 1 |
| 22 | C-4 | 60.0 | 0.19 | 0.07 | 0.12 | D | 1 |
| 23 | C-4 | 5.0 | 0.06 | 0.05 | 0.01 | A | 4 |
| 24 | C-4 | 10.0 | 0.07 | 0.05 | 0.02 | A | 2 |
| 25 | C-4 | 20.0 | 0.09 | 0.05 | 0.04 | A | 2 |
| 26 | C-4 | 40.0 | 0.14 | 0.06 | 0.08 | B | 1 |
| 27 | C-4 | 60.0 | 0.18 | 0.07 | 0.11 | D | 1 |
| 28 | A-3 | 40.0 | 0.15 | 0.05 | 0.10 | B | 1 |
| 29 | A-3 | 80.0 | 0.26 | 0.07 | 0.19 | E | 2 |
| 30 | C-1 | 40.0 | 0.14 | 0.07 | 0.07 | B | 2 |

From the table it is apparent that samples according to the present invention, of which Dr minus Db value falls within a range between 0.02 and 0.10, have excellent image distinguishability especially in the low density portion of the image as well as image sharpness, which critically affects the fatigue feeling of the observer.

Further, it is also obvious that this effect can considerably be enhanced by the use of a flat plate-shaped silver halide particles-containing silver halide photographic emulsion.

EFFECT OF THE INVENTION

According to the present invention, distinguishability of a developed image is improved even in a low image density portion and, therefore, a light-sensitive silver halide photographic material suitable for medical use which is capable of giving less faigue feeling to observers.

What is claimed is:

1. A Light-sensitive silver halide photographic material for x-ray exposure comprising a transparent support and at least one silver halide emulsion layer provided on said support, wherein said photographic material being characterized in that the density of a non-light-exposed portion through a blue-light (Db) is not more than 0.09, and that the density through a red-light (Dr) less that through the blue-light (Db) falls in the range of from 0.02 to 0.10.

2. The light-sensitive silver halide photographic material according to claim 1, wherein said silver halide emulsion layer contains a flat plate-shaped grain of which average aspect ratio is not not more than 4 and the weight percent proportion of said flat shaped grains against the total number of silver halide grains in said silver halide emulsion layer is not less than 50% by weight.

3. A process for manufacturing a light-sensitive silver halide photographic material comprising a transparent support and at least one silver halide emulsion layer provided thereon, characterized in that said process comprises a step of incorporating into either said support or at least one layer constituting said photographic material a dye so that the density of a non-light-exposed portion through a blue-light (Db) is not more than 0.09, and that the density through a red-light (Dr) less that through the blue-light (Db) falls in the range of from 0.02 to 0.10.

4. The process of claim 3, wherein said support is incorporated with a dye having absorption maxima at a wavelength within a range from 570 to 700 μm.

5. A process for manufacturing a light-sensitive silver halide photographic material comprising a transparent support and at least one silver halide emulsion layer provided thereon, wherein said process comprises incorporating into either said support or said layer a dye wherein a blue light density ($D_b$) of a non-light-exposed portion of a developed image by the following prescribed steps in an automatic processing machine described below is not more than 0.09, and that a red light density ($D_r$) developed by said steps minus ($D_b$) is from 0.02 to 0.10;

| Process | Processing Temperature [°C.] | Processing period [sec] |
|---|---|---|
| Development | 35 | 25.5 |
| Fixing | 34 | 15.9 |
| Rinse | 33 | 12.4 |
| Drying | 45 | 25.2 |

Konica X-ray Automatic Processor Type SRX-501 (Manufactured by Konica Corporation).

* * * * *